US009596918B2

(12) United States Patent
Malvar et al.

(10) Patent No.: US 9,596,918 B2
(45) Date of Patent: Mar. 21, 2017

(54) DEVICES AND METHODS FOR PRESSURIZED DELIVERY OF MATERIALS IN COSMETIC DISPENSERS

(75) Inventors: Michael Malvar, Oceanside, NY (US); Volker Schrepf, East Islip, NY (US)

(73) Assignee: Albéa Services, Gennevilliers (FR)

( * ) Notice: Subject to any disclaimer, the term of this patent is extended or adjusted under 35 U.S.C. 154(b) by 1125 days.

(21) Appl. No.: 11/977,656

(22) Filed: Oct. 25, 2007

(65) Prior Publication Data

US 2009/0020551 A1 Jan. 22, 2009

Related U.S. Application Data

(60) Provisional application No. 60/854,494, filed on Oct. 26, 2006.

(51) Int. Cl.
*A45D 40/24* (2006.01)
*A45D 40/26* (2006.01)

(52) U.S. Cl.
CPC ..... *A45D 40/24* (2013.01); *A45D 40/265* (2013.01)

(58) Field of Classification Search
CPC ..... A45D 40/24; A45D 40/265
USPC ..... 401/9–11, 183, 193, 197, 203, 207, 265, 401/137, 139
See application file for complete search history.

(56) References Cited

U.S. PATENT DOCUMENTS

| | | | | |
|---|---|---|---|---|
| 3,343,552 | A * | 9/1967 | Steffen | 132/320 |
| 3,352,623 | A * | 11/1967 | Sanet | 401/10 |
| 3,823,797 | A * | 7/1974 | Ducatillon | 184/16 |
| 3,951,157 | A * | 4/1976 | Idec | A45D 33/00 401/130 |
| 4,606,777 | A * | 8/1986 | Brow | 401/10 |
| 4,995,749 | A * | 2/1991 | Gornik | 401/9 |
| 5,288,359 | A * | 2/1994 | Stobbie et al. | 401/9 |
| 2002/0025211 | A1* | 2/2002 | Gueret | A45D 40/04 401/130 |
| 2006/0093425 | A1* | 5/2006 | Gueret | 401/129 |

* cited by examiner

*Primary Examiner* — Mark A Laurenzi
*Assistant Examiner* — Bradley Oliver
(74) *Attorney, Agent, or Firm* — Cooper & Dunham LLP

(57) ABSTRACT

Cosmetic dispensers, and methods of use of such dispensers, for transferring material onto an applicator head through a transfer chamber and/or nozzle by applying force or pressure to the material.

9 Claims, 16 Drawing Sheets

DEVICES AND METHODS FOR PRESSURIZED DELIVERY OF MATERIALS IN COSMETIC DISPENSERS

CROSS-REFERENCE TO RELATED APPLICATIONS

This application claims the benefit of U.S. Provisional Application No. 60/854,494 filed Oct. 26, 2006, hereby incorporated by reference.

BACKGROUND OF THE INVENTION

This invention relates to cosmetic dispensers which include applicators having a core or stem and an applicator head constituted of an array of fibers carried by the core forming a brush for transporting and applying cosmetic material. In one specific sense, the invention is directed to cosmetic dispensers in which pressure is used to deliver the cosmetic material to the head while minimizing or eliminating delivery of material to the core.

In traditional cosmetic dispensers, both the applicator head and at least a portion of the stem are inserted into the storage compartment, that is, the portion of the dispenser containing the cosmetic material. As the applicator contacts the cosmetic material, some of the material transfers from the storage compartment onto the applicator head. However, at least three unavoidable results of this contacting step are that, typically: (1) too much material transfers to the applicator head; (2) the distribution of material on the applicator head is uncontrolled and thus somewhat random; and (3) some material transfers onto the stem.

To correct for these results, traditional dispensers typically include a wiper. The wiper removes excess material from both the applicator and stem, more evenly distributes the transferred material on the applicator head, and cleans the stem. To achieve this correction, however, both the wiper opening and the stem should have a similar profile. For most traditional dispensers, this profile is usually circular.

Further, the length of the stem must be sufficiently long to reach the material in the storage compartment, and especially the material at the farthest end, usually the bottom, of the storage compartment. For long or deep storage compartments, the stem can become too long, that is, the distance between the applicator head and the user's hand is so long that the applicator is awkward and difficult to control.

SUMMARY OF THE INVENTION

An object of the invention is to provide a chamber in a cosmetic dispenser for distributing material onto an applicator head so that the stem and the opening to the storage compartment or reservoir need not conform to the requirements of a wiper or the structure of the storage compartment.

Another object of the invention is to provide a cosmetic dispenser in which the material is pushed onto the applicator instead of the applicator head pulling the material out of the cosmetic dispenser.

A further object of the invention is to provide a cosmetic dispenser in which the stem need not be dipped into the storage compartment allowing the stem to remain clean without wiping.

An additional object of the invention is to provide a cosmetic dispenser in which the length of the stem can be designed ergonometrically and for optimal application by a user instead of being dependent on the dimensions of the storage compartment.

A further object of the invention is to provide a cosmetic dispenser in which the wiper can be optimized solely to control the distribution of material on the applicator head instead of also having to wipe the stem and remove excess material from the applicator head.

DETAILED DESCRIPTION OF THE PREFERRED EMBODIMENT

Figure 1:
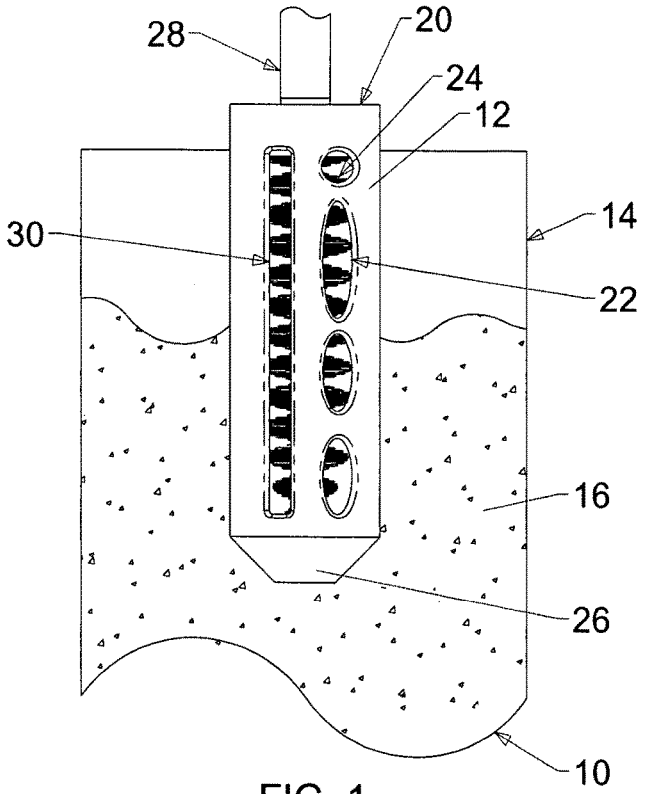
FIG. 1 is a front cross-sectional view of a cosmetic dispenser with a single wall transfer chamber according to one embodiment of the invention.
Figure 2:
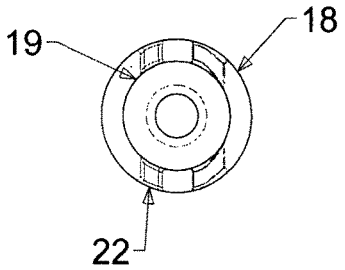
FIG. 2 is a top view of the single wall transfer chamber of FIG. 1.

As shown in FIGS. 1 and 2, one embodiment of this invention employs a cosmetic dispenser 10 having a transfer chamber 12 and a storage compartment 14 for holding the material 16. In this embodiment, the transfer chamber 12 has a single wall 18 defining an applicator receiving space 19, at least one opening 20 for receiving an applicator, and one or more orifices 22, 30 in the wall through which material 16 can flow. Because the material 16 has a density which prevents the material from easily flowing through the orifices 22, 30 into the receiving space 19 without the application of external pressure or an internal vacuum, the material remains outside of the transfer chamber 12 until a pressure differential is applied. When the pressure differential is applied, typically by the user, the material 16 flows through the orifices 22, 30 into the receiving space 19 and onto the applicator head 24.

The orifices 22, 30 are preferably positioned only along that portion of the receiving chamber 19 where the applicator head 24 is positioned when properly inserted into the transfer chamber 19. Proper insertion can be indicated to the user by forming the transfer chamber 12 with an end wall 26 or other stop which prevents the distal end of the applicator head 24 from being further inserted into the storage compartment 14. In this way, delivery of the material 16 is limited to the applicator head 24 leaving the stem 28 essentially free of the material.

In one embodiment, one or more of the orifices 22, 30 is thin and elongated along the longitudinal axis of the transfer chamber. Such elongated openings or 'tracks' 30 result in beads of the material 16 being applied to the applicator head 24 when pressure is applied. Such beads allow for a greater volumizing effect on a user's lashes when the material 16 is mascara.

Figure 3:
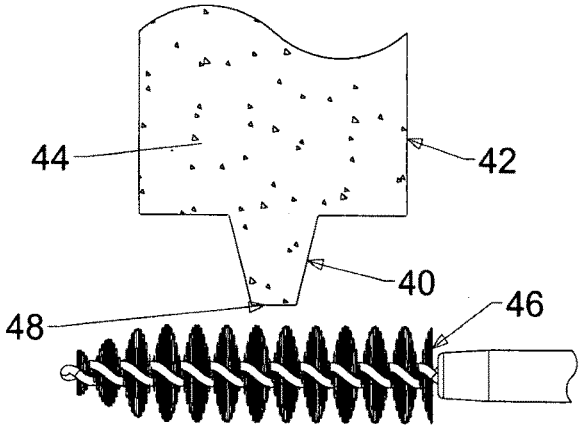
FIG. 3 is a diagrammatic view of a cosmetic dispenser with a nozzle and a brush according to one embodiment of the invention.

FIG. 3 illustrates an embodiment of the invention in which the user can control a nozzle 40 connected to a supply 42 of material 44. In such an embodiment, the material 44 is emitted from the nozzle 40 under pressure and the user guides the material 44 to desired positions on the applicator head 46. However, unlike the transfer chamber 12 discussed above, the user is unlikely to consistently control the delivery of the material 44, and holding the nozzle 40 to an exposed applicator head 46 can be awkward and messy.

Accordingly, in another embodiment of the invention with a nozzle 40, the nozzle opening 48 can be placed over or be attached one or more of the orifices 22 of a transfer chamber 12 to guide the material 44 to the applicator head 24 without requiring the user to regulate the distribution of the material on the applicator head.

However, as shown in FIG. 1, and in several embodiments of the invention, the transfer chamber 12 is connected to the storage compartment 14 so that the material 16 surrounds, or under pressure, flows to surround, the orifices 22, 30 of the transfer chamber. Accordingly, when appropriate pressure is applied to the storage compartment 14, the material 16 flows through the orifices 22, 30 and onto the applicator head 24 without the need for the user to establish, or maintain, a connection between the storage compartment and the transfer chamber 12.

Figure 4:
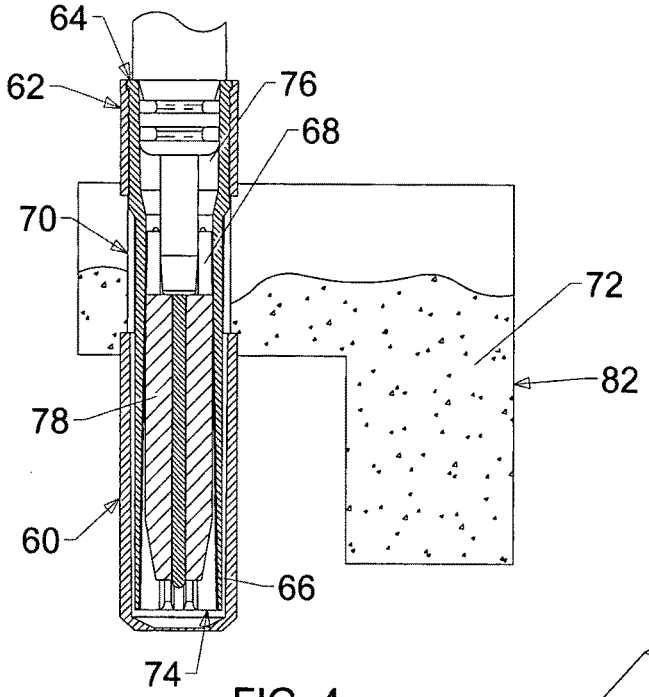
FIG. 4 is a cross-sectional view of a cosmetic dispenser with a double wall transfer chamber according to one embodiment of the invention.

FIG. 4 illustrates another embodiment of the invention in which the transfer chamber 60 has two walls 62, 64 thereby providing an outer chamber 66 at least partially surrounding the applicator receiving space 68. Outer orifices 70 are provided in the outer wall 62 for receiving the material 72 into the outer chamber 66, and inner orifices 74 are provided for delivering material from the outer chamber 66 into the receiving space 68. The opening 76 of this transfer chamber 60 permits insertion of the applicator head 78 into the receiving space 68. In this embodiment, when the pressure differential is applied, the material 72 flows through the outer orifices 70 and into the outer chamber 66. From the outer chamber 66, the pressure differential causes the material 72 to flow to and through the inner orifices 74 into the receiving space 68 where the material is delivered or injected onto the applicator head 78.

As shown in FIG. 4, the outer orifices 70 need not be aligned with the inner orifices 74 thereby removing the need to locate the storage compartment 82 with respect to the inner orifices 70. Indeed, the storage compartment 82 can be remote from the inner orifices 74 which allows for unique design possibilities.

The pressure differential for causing transfer of the material through the transfer chamber or nozzle to the applicator head can be provided by many means, for example, a collapsible tube, a plunger, a pump and/or a traveling disc.

Figure 5:
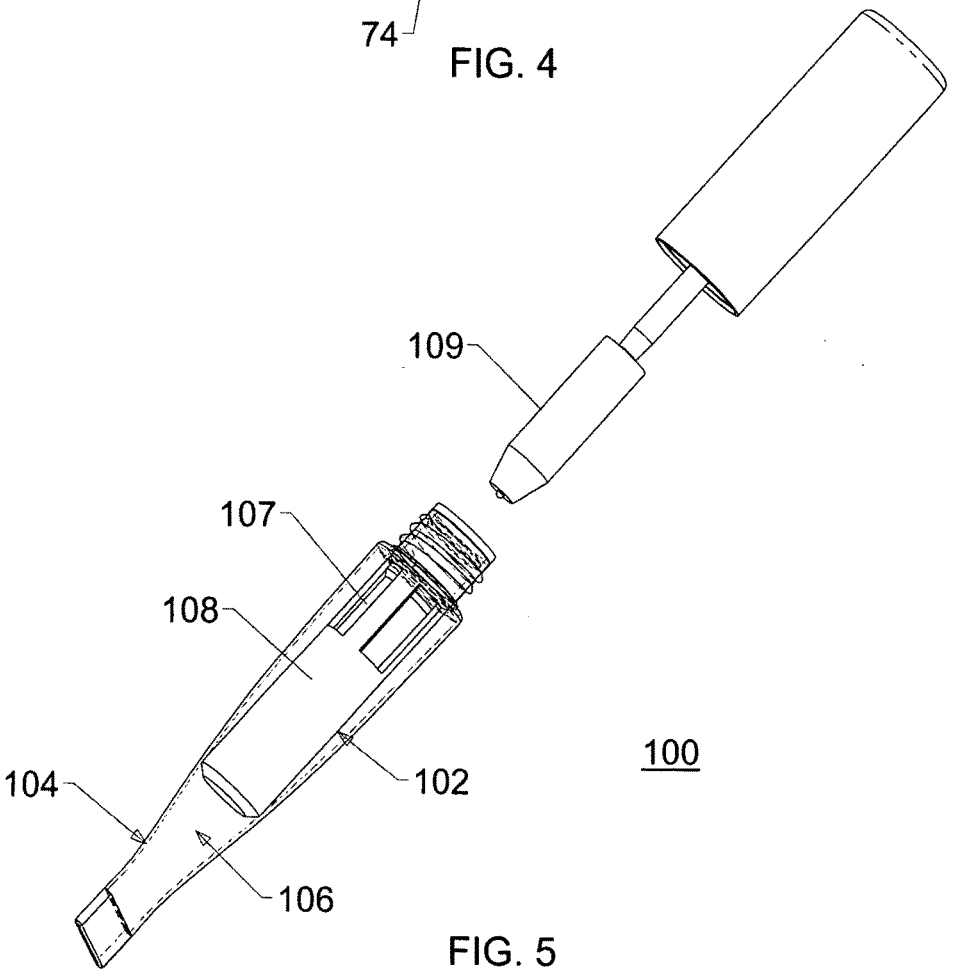
FIG. 5 is a partially transparent perspective view of a cosmetic dispenser with a collapsible tube storage compartment and an embedded transfer chamber according to one embodiment of the invention.

FIGS. 5-9 show embodiments employing a collapsible tube. In FIG. 5, as in FIGS. 1 and 2, the transfer chamber 102 of the cosmetic dispenser 100 is at least partially inserted into the collapsible tube storage compartment 104. To create a pressure differential, the user, after inserting the applicator head 109 into the receiving space 108, squeezes the pliable walls of the storage compartment 104 causing the material 106 to flow through the orifices 107 into the receiving space 108 and thereby deliver the material 106 to the applicator head 109.

Figure 6:
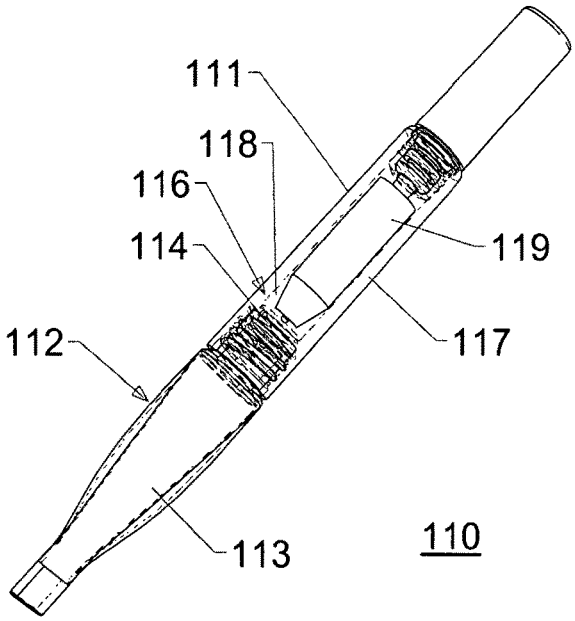
FIG. 6 is a partially transparent perspective view of a cosmetic dispenser with a collapsible tube storage compartment and an adjacent double wall transfer chamber according to one embodiment of the invention.

In FIG. 6, the cosmetic dispenser 110 has a double wall transfer chamber 111 located above the collapsible tube storage compartment 112. In this embodiment, when the user squeezes the pliable wall of the storage compartment 112, the material 113 is forced through outer orifices 114 into the outer chamber 116 and then through the inner orifices 117 into the receiving space 118 where the material 113 is delivered to the applicator head 119.

Figure 7:
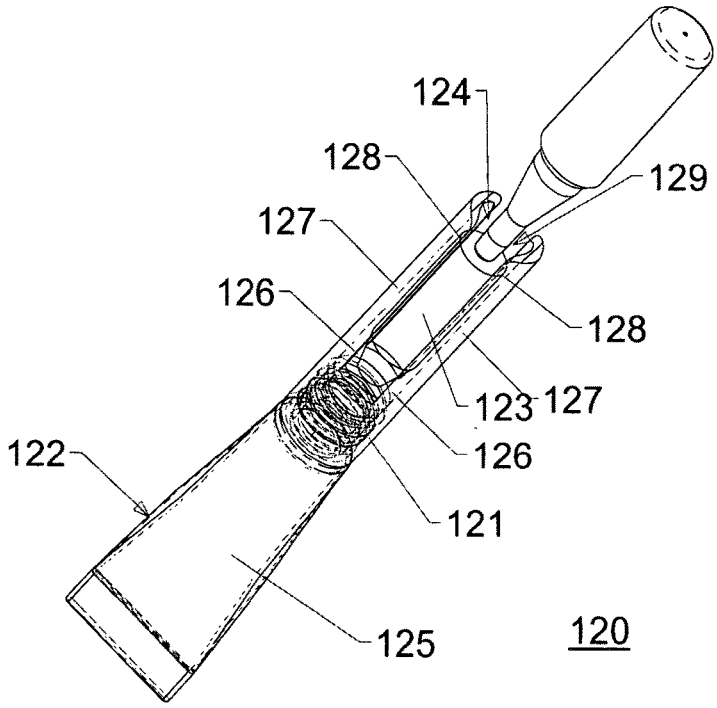
FIG. 7 is a partially transparent perspective view of a cosmetic dispenser with a collapsible tube storage compartment and dual transfer chambers according to one embodiment of the invention.

Similar to FIG. 6, FIG. 7 illustrates a cosmetic dispenser 120 with a double wall transfer chamber 121 located above a collapsible tube storage compartment 122. However, instead of a transfer chamber 121 completely surrounding the applicator head 123, the transfer chamber 121 has two sections separated by slits 124. In this embodiment, when the user squeezes the pliable wall of the storage compartment 122, the material 125 is forced through outer orifices 126 into one of the two outer chambers 127 and then through the respective inner orifices 128 into the receiving space 129 where the material 125 is delivered to the applicator head 123.

By separating the storage compartment 122 into two sections, this embodiment also allows for the two outer chambers 127 to deliver different materials to different portions of the applicator head 123. In such a variation, each separate section of the storage compartment 122 is connected only to the outer orifices 126 of one of the outer chambers 127.

Figure 8:
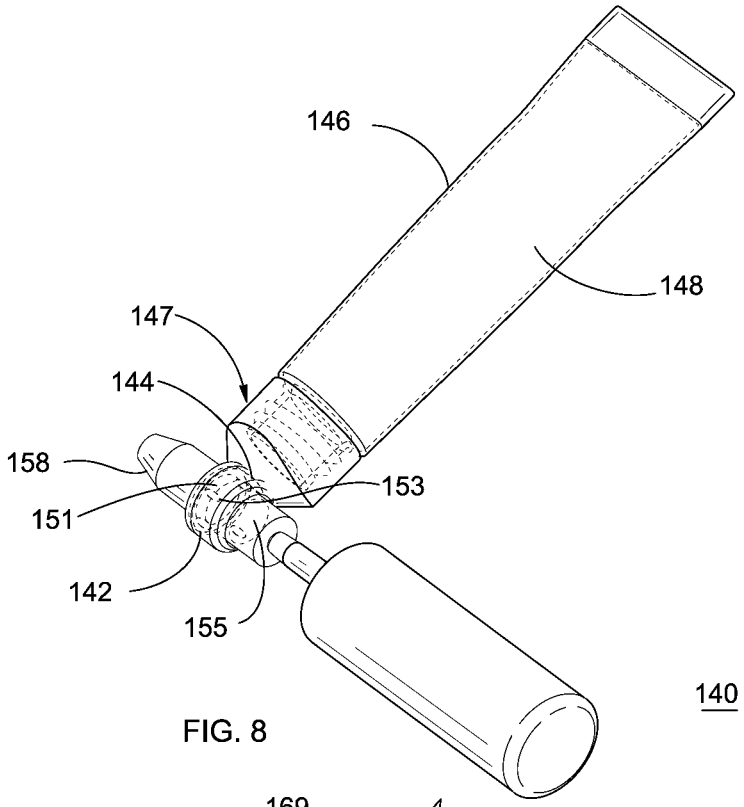
FIG. 8 is a partially transparent perspective view of a cosmetic dispenser with a collapsible tube storage compartment and a ring-shaped transfer chamber according to one embodiment of the invention.

FIG. 8 illustrates a cosmetic dispenser 140 with a double wall transfer chamber 142 having an outer orifice 144 connected to a collapsible tube storage compartment 146 with a nozzle 147. In this embodiment, when the user squeezes the pliable wall of the storage compartment 146, the material 148 is forced out of the nozzle 147 and through outer orifices 144 into the ring-shaped outer chamber 151.

Since the shape and size of the transfer chambers according to the invention can be varied based on the desired distribution of material on the applicator head, the transfer chamber can be longer than, as long as, or shorter than the applicator head. Thus, for example, in FIG. 8, the transfer chamber 142 is ring-shaped. Accordingly, when the material 148 flows from the outer chamber 151 through the inner orifices 153 into the receiving space 155, the material 148 is delivered only to the portion of the applicator head 158 positioned adjacent the inner orifices. To apply material 148 along the length of the applicator head 158, the user can move the applicator head through the receiving space 155 while simultaneously squeezing the collapsible tube storage compartment 146.

Figure 9:
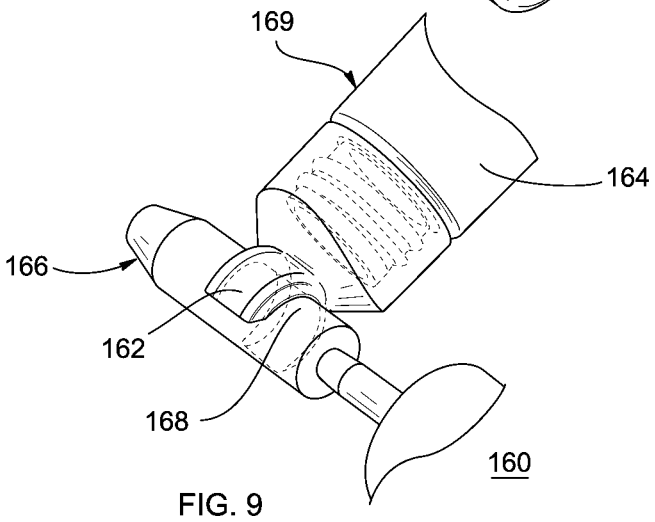
FIG. 9 is a partially transparent perspective view of a cosmetic dispenser with a collapsible tube storage compartment and a partial ring-shaped transfer chamber according to one embodiment of the invention.

FIG. 9 illustrates a cosmetic dispenser 160 similar to FIG. 8, except that instead of a ring-shaped outer chamber, the outer chamber 162 is semi-circular allowing the delivery of material to only one longitudinal portion of the applicator head 166. However, should the user desire to apply material 164 along the entire length and circumference of the applicator head 166, the user can spin and move the applicator head through the receiving space 168 while simultaneously squeezing the collapsible tube storage compartment 169 or pass the applicator head 166 through the receiving space 168 twice, once for each side.

Figure 10:
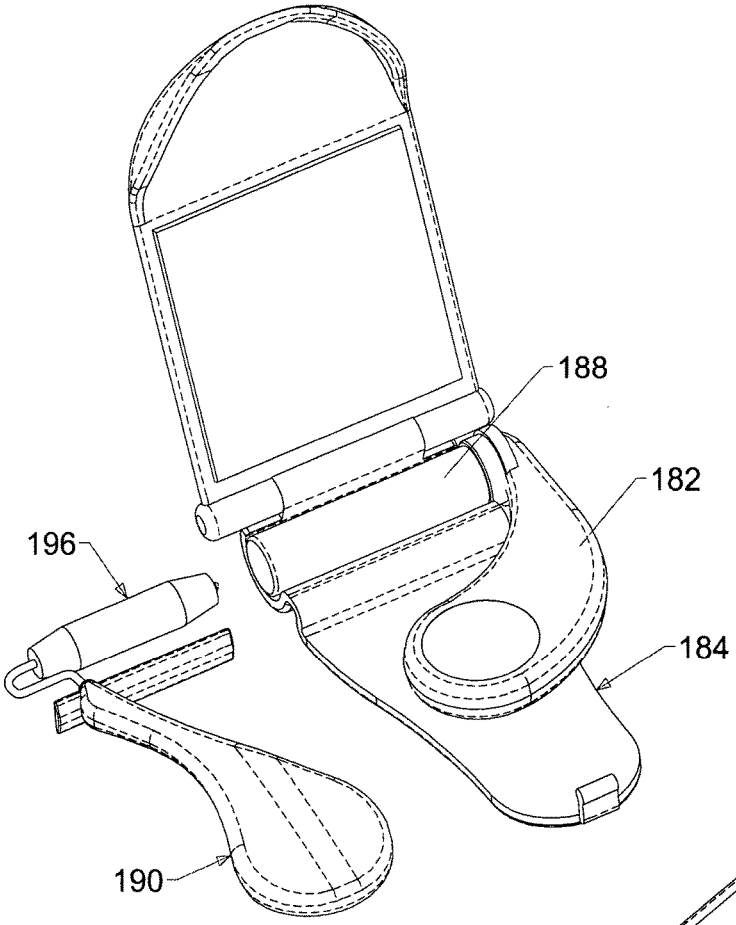
FIG. 10 is a perspective view of a cosmetic dispenser with a bladder storage compartment and a lever according to one embodiment of the invention.
Figure 11:
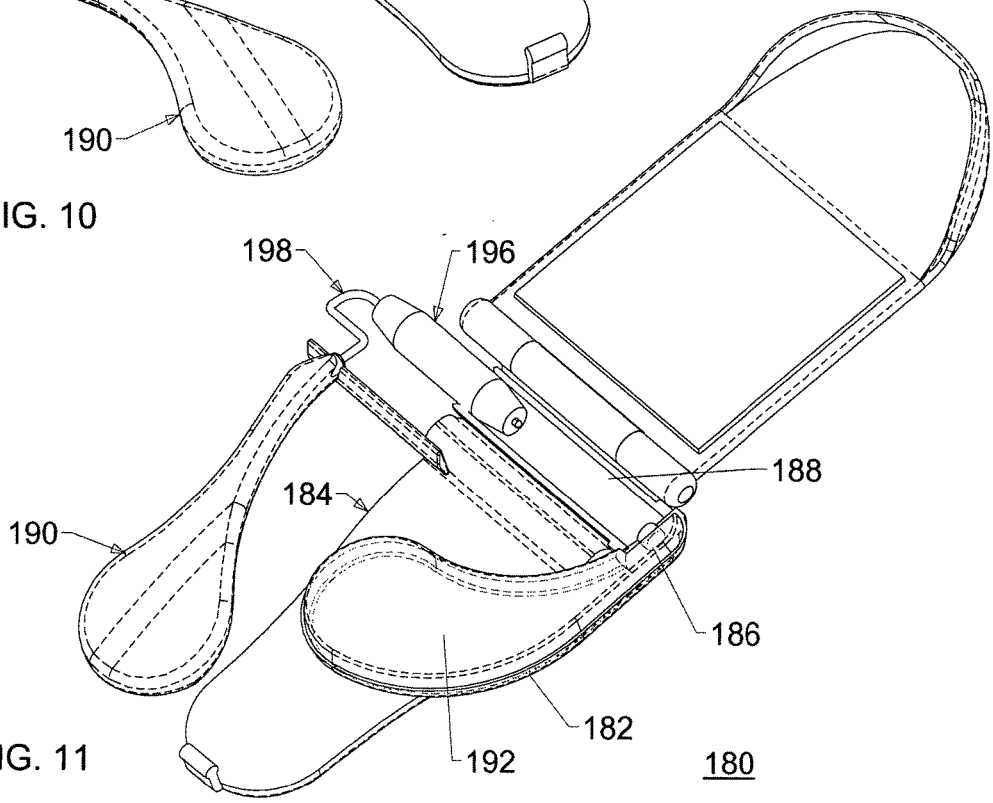
FIG. 11 is a close-up partially cut-away perspective view of the cosmetic dispenser of FIG. 10.

FIGS. 10-15B show embodiments employing a plunger. In FIGS. 10 and 11, the cosmetic dispenser 180 has a storage compartment formed as a bladder 182. At least a portion of the bladder 182 is placed or mounted on a support 184 and another portion of the bladder is connected to the orifice 186 of a transfer chamber 188. A lever 190 is positioned proximate the bladder 182 such that when the lever 190 is depressed or plunged, the bladder 182 is squeezed between the lever 190 and the support 184 causing material 192 in the bladder to flow through the orifice 186 and into the transfer chamber 188 where the material flows or is injected onto the applicator head 196. In this embodiment, the lever 190 also serves as a handle for the applicator head 196. In other words, the lever 190 connects to a proximal end of the stem 198 and the distal end of the stem connects to the applicator head 196. Noteworthy is the shape of the stem 198 which need not be longitudinal straight along its entire length as found in conventional cosmetic dispensers. Thus, the applicator head 196 can be at an angle, in FIGS. 10 and 11 a 90 degree angle, with respect to the proximal end of the stem 198.

Figure 12A:
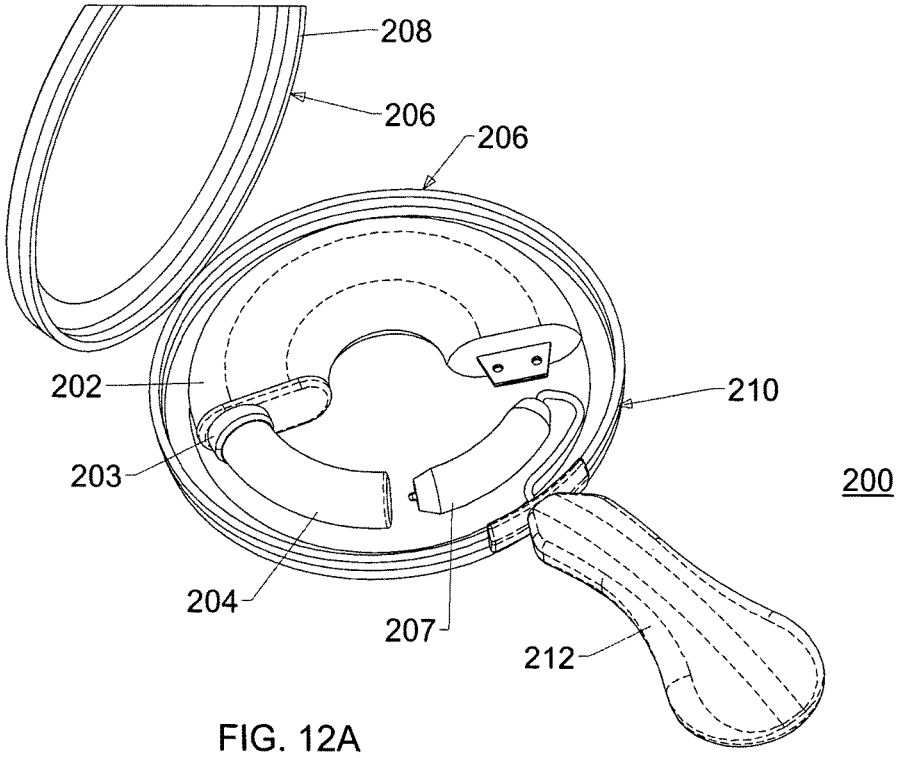
FIG. 12A is a perspective view of a cosmetic dispenser with a bladder storage compartment in a clam-shell housing according to one embodiment of the invention.
Figure 13:
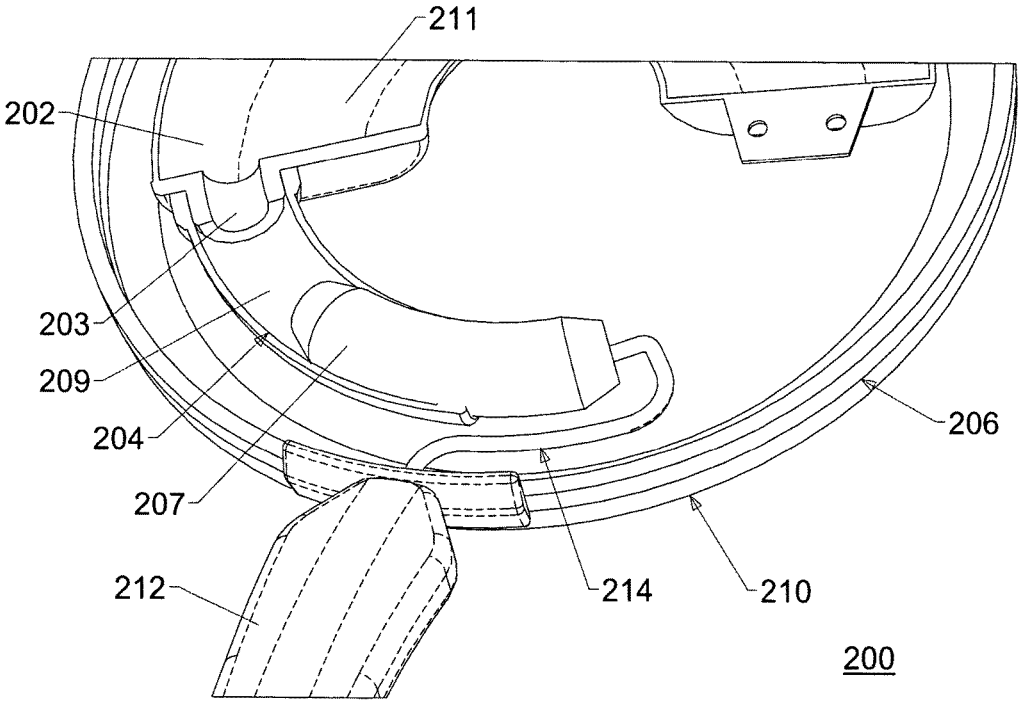
FIG. 13 is a close-up partially cut-away perspective view of the cosmetic dispenser of FIG. 12A.

In FIGS. 12A and 13, the cosmetic dispenser 200 has a bladder 202 connected to the orifice 203 of a curved transfer chamber 204 placed or mounted inside a clam-shell or make-up compact housing 206. When one side 208 of the housing 206 is pressed toward the other side 210 of the housing, material 211 in the bladder flows through the orifice 203 into the receiving space 209 of the transfer chamber 204 and then onto the curved applicator head 207. The sides 208, 210 of the housing 206 allow for the housing to be opened so that when the handle 212 connected to the stem 214 is rotated out of the receiving space 209 the applicator can be removed for application of the material 211 by the user.

Figure 12B:
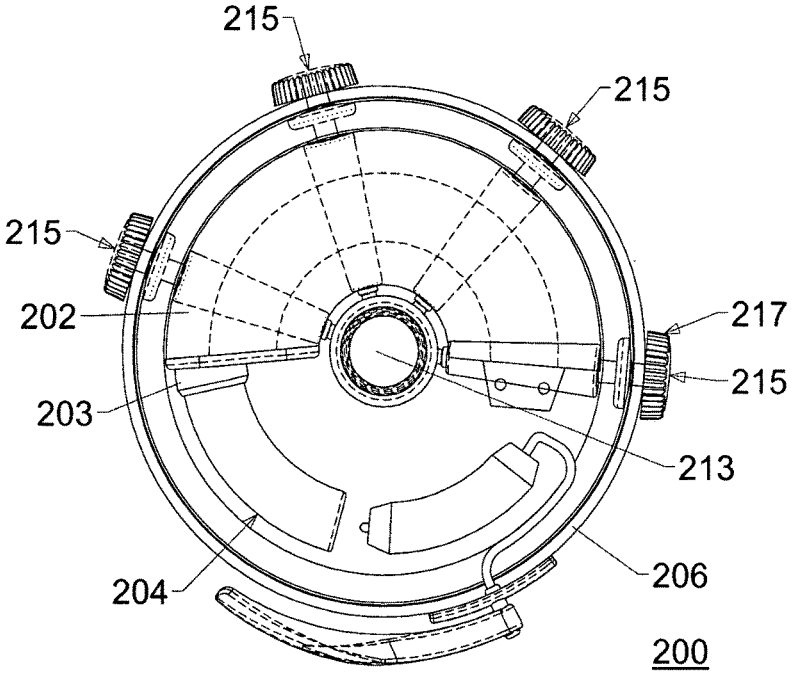
FIG. 12B is a top view of a bladder storage compartment with a roller according to one embodiment of the invention.
Figure 12C:
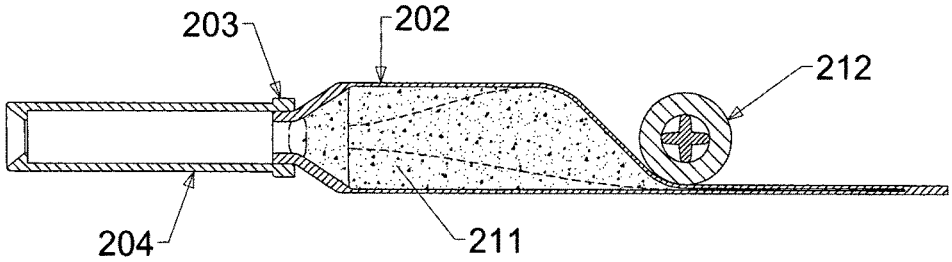
FIG. 12C is a cross-sectional view of the bladder storage compartment and a roller which flattens the bladder according to one embodiment of the invention.
Figure 12D:
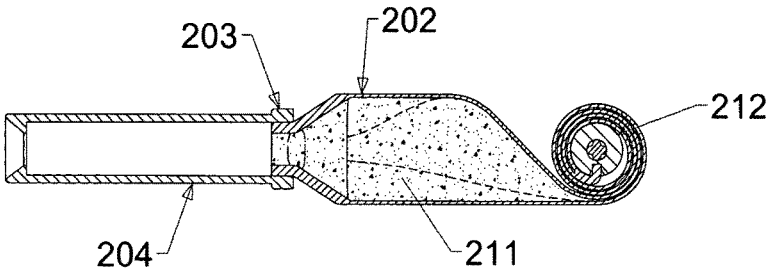
FIG. 12D is a cross-sectional view of the bladder storage compartment and a roller which rolls up the bladder according to another embodiment of the invention.

FIGS. 12B, 12C, and 12D illustrate other embodiments similar to the embodiment of FIG. 12A, but with a roller 212 for causing the material 211 to flow from the bladder 202 through the orifice 203 and into the transfer chamber 204.

In the embodiment of FIG. 12C, the roller 212 connects to a hinge axis 213 in the center of the housing 206 and can be rotated by sliding over the curved bladder 202 thereby pressing or flattening the flexible walls of the bladder toward each other. This pressure causes the material 211 to flow out of the bladder 202 and into the transfer chamber 204. The roller 212 can be slid by a user using a knob 217 connected to the roller.

In the embodiment of FIG. 12D the bladder 202 rolls up onto the roller 212 as the roller is pivoted about the hinge axis 213 thereby pressing the walls of the bladder 202 together which pressurizes the material 211. In this embodiment, the connection between the roller 212 and the hinge axis 213 permits the roller, which is connected to knob 217, to spin about the roller axis.

In another embodiment, stop positions 215 for the roller 212 can be built into, or marked on, the housing 206 to indicate to the user when a sufficient amount of material 211 has flowed into the transfer chamber 204.

Figure 14A:
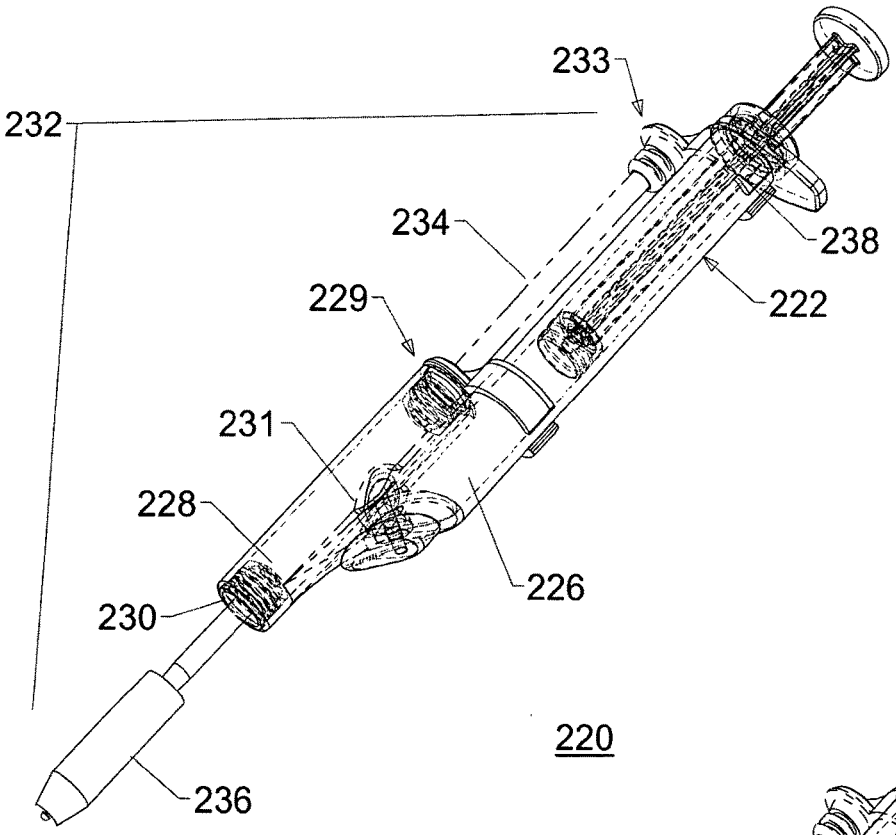
FIG. 14A is a partially transparent perspective view of a cosmetic dispenser with a dual opening transfer chamber and a syringe-type applicator according to one embodiment of the invention.
Figure 14B:
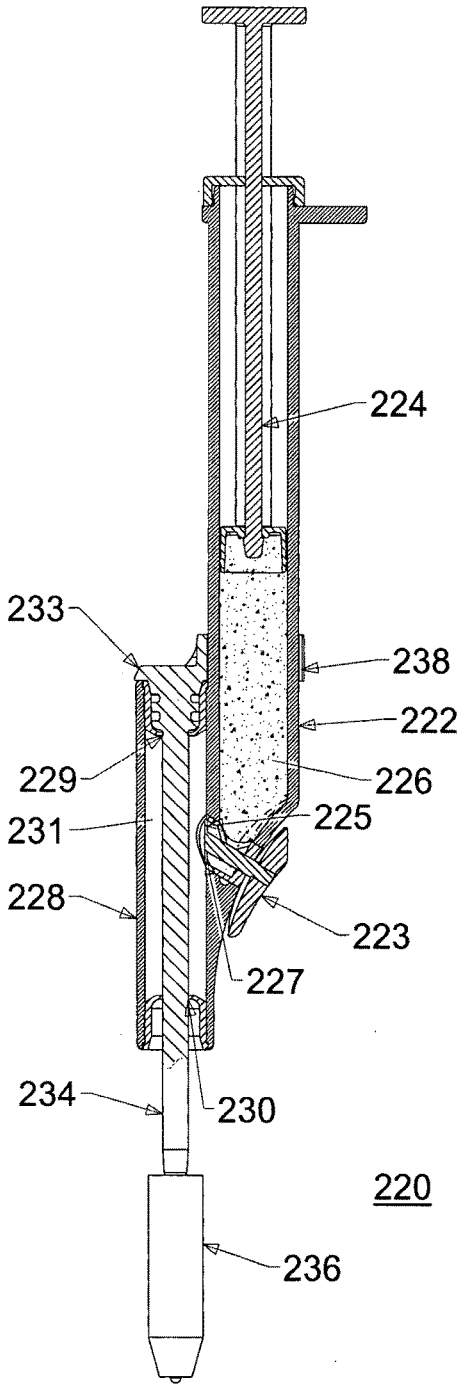
FIG. 14B is a cross-sectional side view of a cosmetic dispenser with a dual opening transfer chamber and a syringe-type applicator according to one embodiment of the invention.

In FIGS. 14A and 14B, the cosmetic dispenser 220 has a storage compartment 222 with a plunger 224. When depressed, the plunger 224 pressurizes the material 226 pushing the material toward the distal end of the storage compartment 222 which is connected to the orifice 227 of a transfer chamber 228 thereby causing the material 226 to flow into the transfer chamber 228.

In one embodiment of the invention, a valve 225 which can have a resettable trigger 223 is provided to prevent the flow of material 226 from the storage compartment 222 into the transfer chamber 228 until the valve is opened. The valve 225 allows greater pressure to build in the storage compartment 222.

One advantage in employing a transfer chamber is that an applicator can pass through the transfer chamber in various directions and along various paths. Thus, in FIGS. 14A and 14B, transfer chamber 228 has two openings 229, 230 into the receiving space 231 for use with a syringe-type applicator 232. This applicator 232 has an actuator 233 connected to the stem 234 which in turn is connected to the applicator head 236. The first opening 229 of the transfer chamber 228 is large enough to allow the stem 234 to move longitudinally through the receiving space 231. The second opening 230 is large enough to allow the applicator head 236 to be moved out from the receiving space 231. When the actuator 233 is depressed the applicator head 236 which is connected to the actuator 233 by the stem 234 is also depressed and moves out of the transfer chamber 228 so the user can apply the material. Material 226 is applied to the applicator head 236 by depressing the plunger 224 while the applicator head 236 is positioned in the receiving space 231. A glide 238 which slides along the storage compartment 222 independently of the plunger 224 is attached to the actuator 233 to guide the applicator 232 into and out of the receiving space 231.

Figure 15A:
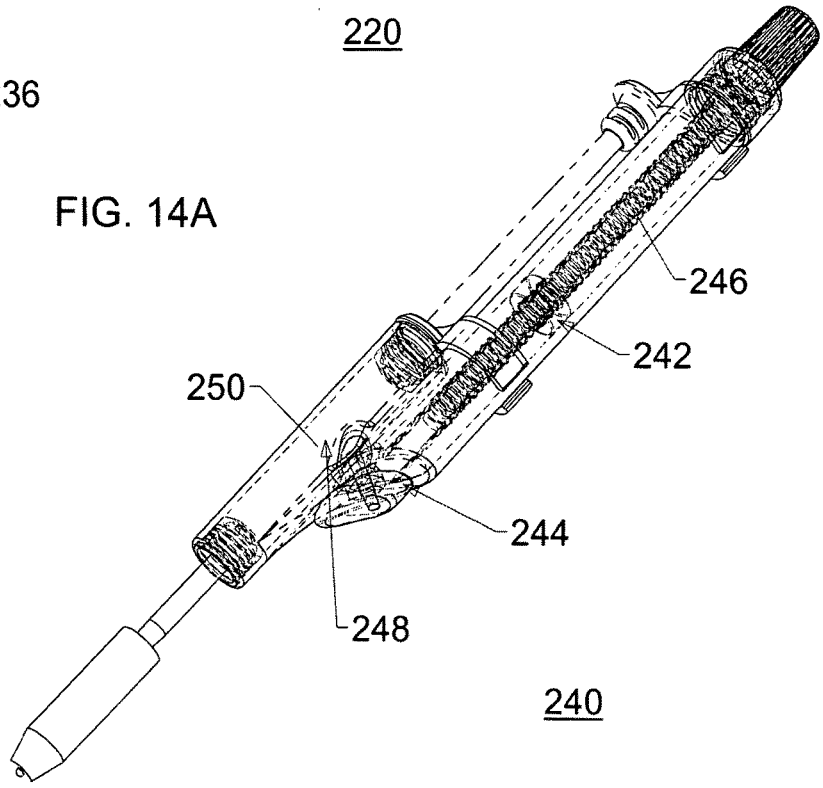
FIG. 15A is a partially transparent perspective view of a cosmetic dispenser with a rotary plunger according to one embodiment of the invention.
Figure 15B:
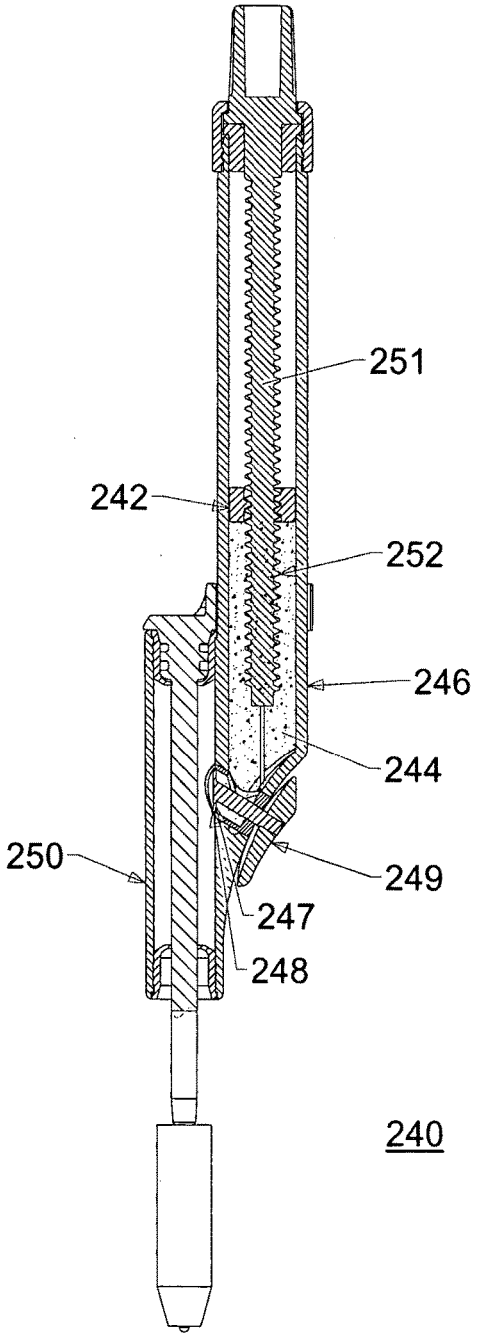
FIG. 15B is a cross-sectional side view of a cosmetic dispenser with a rotary plunger according to one embodiment of the invention.

FIGS. 15A and 15B show an embodiment employing a traveling disc for a cosmetic dispenser 240 according to the invention. Similar to the plunger 224 shown in FIGS. 14A and 14B, the traveling disc 242 pushes the material 244 toward the distal end of the storage compartment 246 which is connected to the orifice 248 of a transfer chamber 250. However, unlike the plunger 224, the traveling disc 242 is rotated along a threaded screw 251 which provides a spiral or helical path 252 for the traveling disc 242. Similar to the embodiment of FIGS. 14A and 14B, this embodiment can have a valve 247 which also can have a resettable trigger 249 to prevent material 244 from flowing from the storage compartment 246 into the transfer chamber 250 until the valve is opened.

Figure 16A:
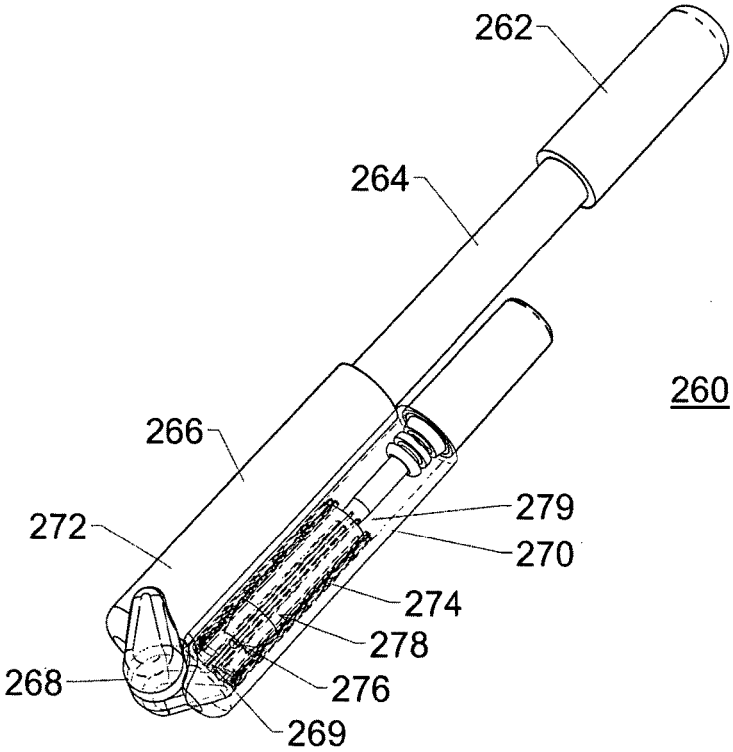
FIG. 16A is a partially transparent perspective view of a cosmetic dispenser with a pump and a joint connecting the transfer chamber to the storage compartment in a folded position according to one embodiment of the invention.
Figure 16B:
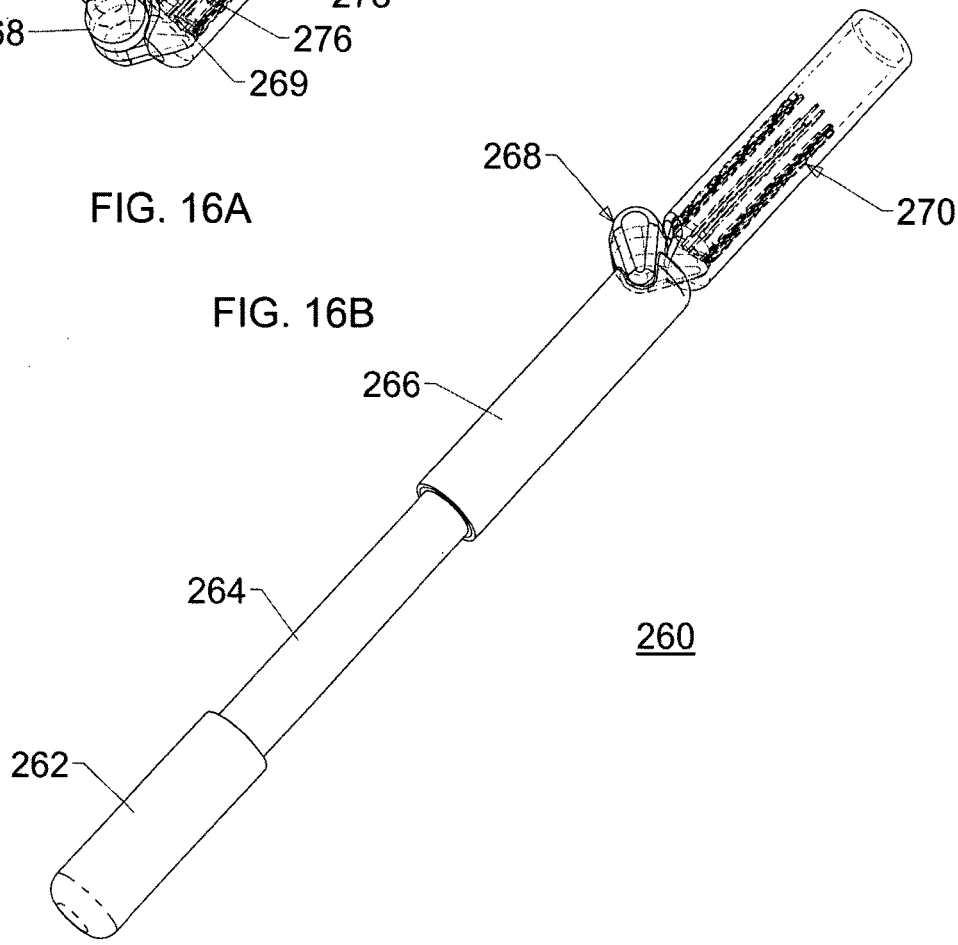
FIG. 16B is a partially transparent perspective view of the cosmetic dispenser of FIG. 16A with the joint in an unfolded position according to one embodiment of the invention.

FIGS. 16A and 16B show an embodiment employing a pump according to the invention. In FIGS. 16A and 16B, the cosmetic dispenser 260 has a pump handle 262 connected to a piston 264 which, when depressed, forces air through a valve (not shown) into the storage compartment 266. The storage compartment 266 also has a transfer valve 268 which, when open, connects the storage compartment 266 to the outer orifice 269 of the transfer chamber 270. When the user repeatedly presses the pump handle 262 and the transfer valve 268 is closed, the material 272 in the storage compartment 266 becomes pressurized from the air forced into the compartment. As shown in FIG. 16A, the transfer valve 268 is closed when the storage compartment 266 is folded adjacent the transfer chamber 270. When the storage compartment 266 is rotated away from the transfer chamber 270 as in FIG. 16B, the transfer valve 268 opens and the pressurized material 272 flows through the outer orifice 269 into the outer chamber 274 and through the inner orifices 276 onto the applicator head 278 in the receiving space 279. Alternatively, the wall of the transfer valve 268 can be provided with a trigger accessible by the user for actuating the valve similar to the triggers 223, 249 shown in FIGS. 14B and 15B.

Figure 17:
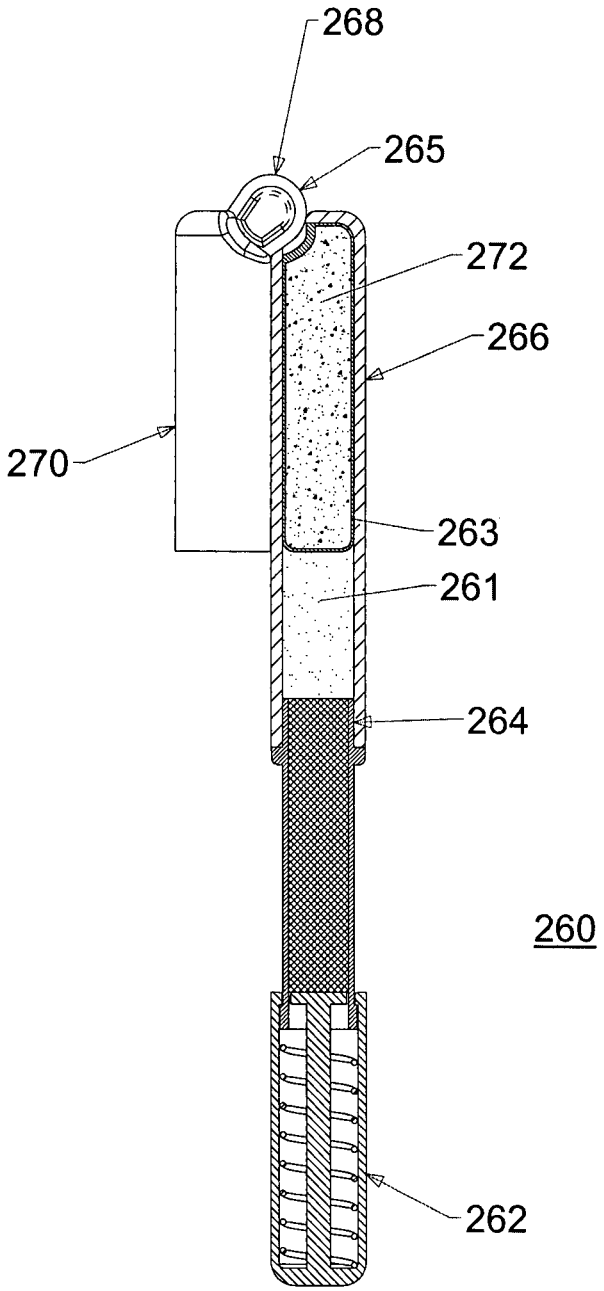
FIG. 17 is a cross-sectional side view of a cosmetic dispenser with a pump and a joint connecting the transfer chamber to the storage compartment in the folded position according to one embodiment of the invention.

FIG. 17 shows another embodiment similar to FIGS. 16A and 16B in which the material 272 is enclosed within a bladder 263 which is placed in the storage compartment 266. In this embodiment, as air is pumped into the air chamber 261 that forms the remainder of the storage compartment 266, the pressure rises and the bladder walls compress pushing the material 272 through the orifice 265, and when open, through the transfer valve 268 into the transfer chamber 270. Because the material is separated by the bladder 263 from the air in this embodiment, the material 272 can be protected from contamination until use. The material 272 can also be separated from the air chamber 261 by a movable disk.

While the embodiments of FIGS. 16A, 16B, and 17 employ a transfer valve 268, these embodiments can instead have a separate valve located elsewhere on the cosmetic dispenser, such as the valves 225, 247 in the storage compartments 222, 246 shown in FIGS. 14B and 15B. In such embodiments, the transfer valve can be replaced with a transfer joint to provide: (1) the passageway for the material between the storage compartment and the transfer chamber; and (2) rotation of the transfer chamber with respect to the storage compartment. Thus, the transfer joint need not include a valve, and for ergonometric reasons, such as better control of the flow rate when dispensing the product and better precision in positioning the brush, the valve can be located elsewhere on the cosmetic dispenser.

Figure 18:
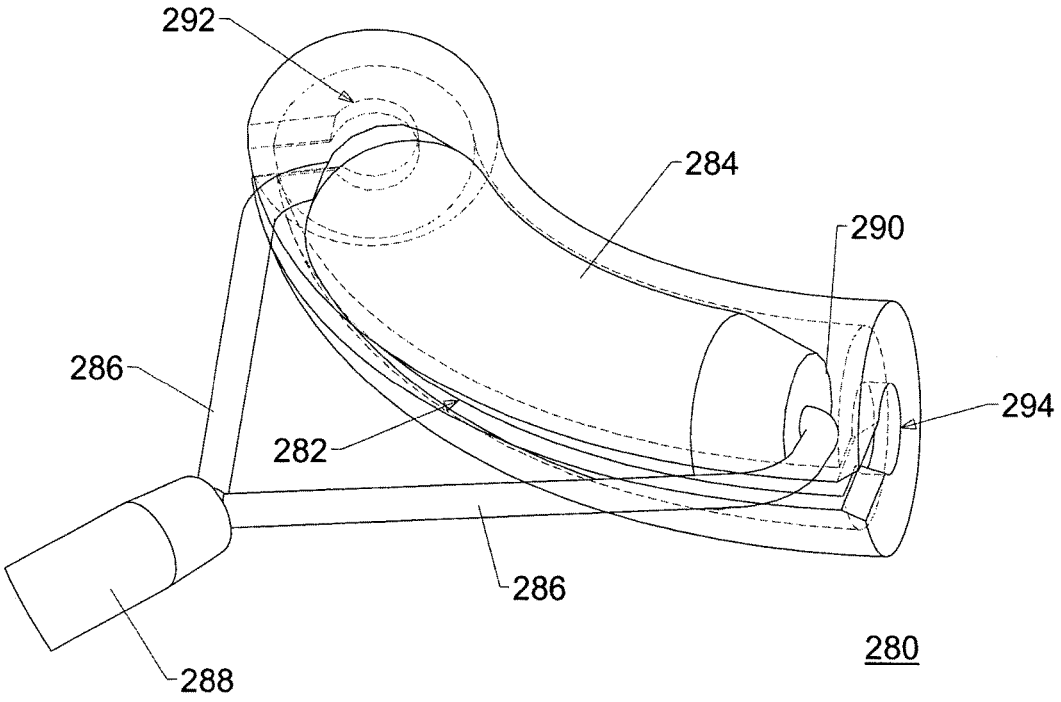
FIG. 18 is a perspective view of cosmetic dispenser with a transfer chamber having a side slit.

FIG. 18 shows another embodiment of the invention in which a curved transfer chamber 280 is formed with a side slit opening 282 for receiving the applicator head 284. Unlike most conventional cosmetic applicators which are connected to the stem, this applicator head 284 is connected to two supports 286, one on each end of the applicator head which are then connected to a stem or handle 288. This embodiment allows a user to insert the applicator head 284 'sideways' through the side slit 282 instead of longitudinally. Once inserted, the user can inject material from a bladder or other storage compartment (not shown) into the receiving space 290 through the orifice 292 and onto the applicator head 284. In a variation of this embodiment, the applicator head 284 can be inserted and/or removed from the receiving space 290 through an end opening 294 in the transfer chamber 280.

As discussed above with respect to the embodiment shown in FIG. 7, the storage compartment can have two sections for storing different material. Indeed, the invention also contemplates that the storage compartment can have more than two sections for more than two different corresponding materials.

Figure 19A:
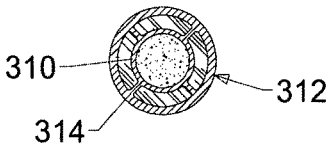
FIGS. 19A, 19B, and 19C are cross-sectional views of a cosmetic dispenser having a collapsible tube storage compartment with separate sections for different materials, showing a top view, a side view, and a side view of the applicator head after the material is applied, respectively.
Figure 19C:
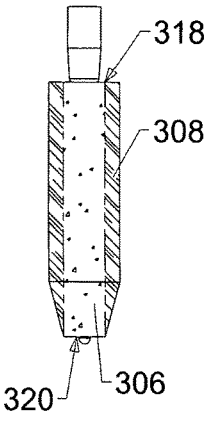
Figure 19B:
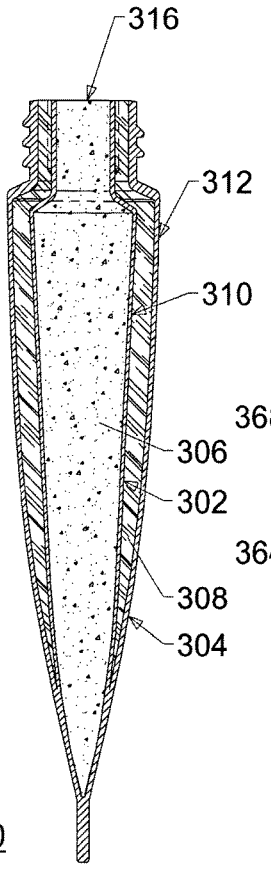

FIGS. 19A and 19B illustrate one embodiment in which a tube storage compartment 300 has an inner section 302 and an outer section 304. One material 306 is stored in the inner section 302 and another material 308 is stored in the outer section 304. The materials 306, 308 are separated by an inner wall 310 which is supported from the walls 312 of the storage compartment 300 by support webbing 314. When squeezed, the materials 306, 308 will flow through orifice 316 into a transfer chamber and then onto an applicator head 318. If the orifice of the transfer chamber receiving material is centered with respect to the core of the applicator head 318, the material 306 from the inner section 302 of the storage compartment 300 will flow through the fibers of the applicator head 318 to surround the center 320 of the applicator head 318 and the material 304 in the outer section 308 of the storage compartment 300 will flow through the edges of the fibers of the applicator head 318 thereby surrounding the material 306 surrounding the center of the applicator head.

Figure 20B:
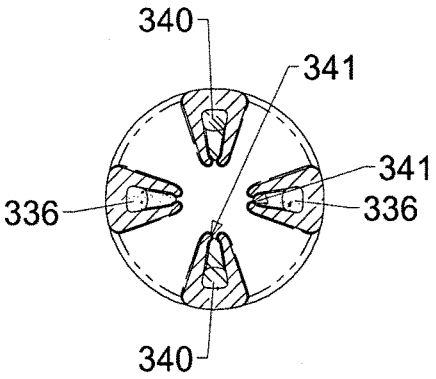
FIGS. 20A, 20B, 20C, 20D, and 20E are cross-sectional views of a cosmetic dispenser having a storage compartment and a transfer chamber with separate sections for delivery of different materials to the applicator head, showing a side view, a section cut view along line C-C of FIG. 20A, a section cut view along line B-B of FIG. 20A, and a section cut view along line A-A of FIG. 20A, and a side view of the applicator head after the materials are applied, respectively.
Figure 20E:
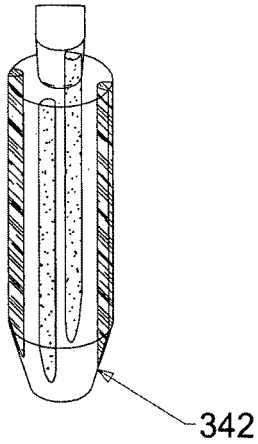
Figure 20C:
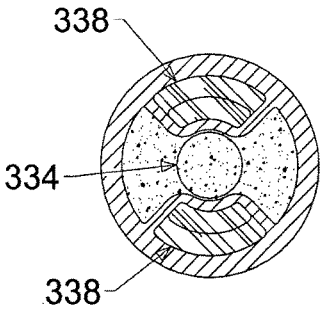
Figure 20D:
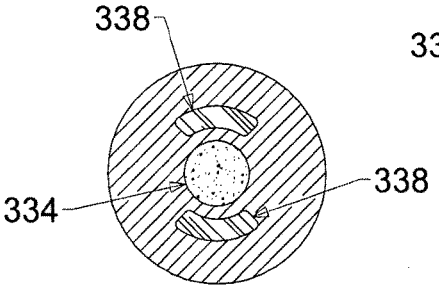
Figure 20A:
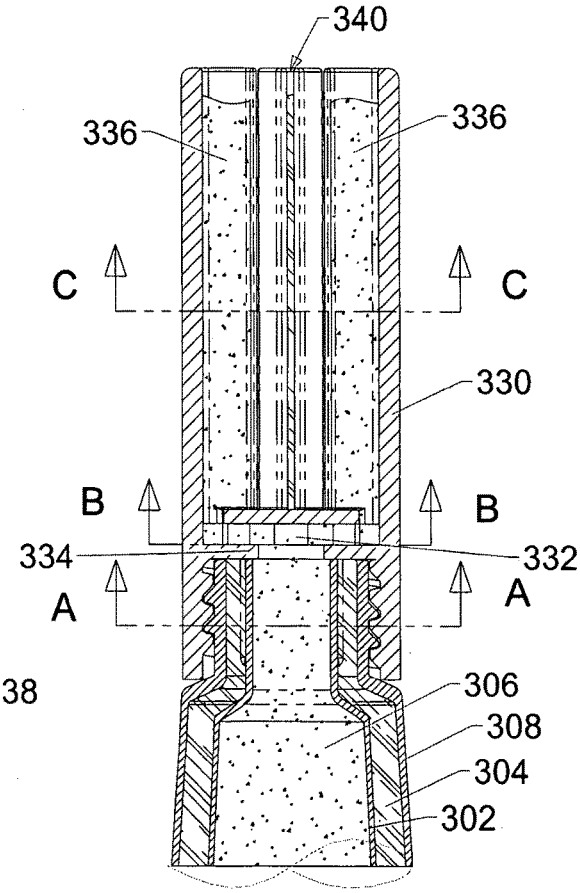
Figure 22A:
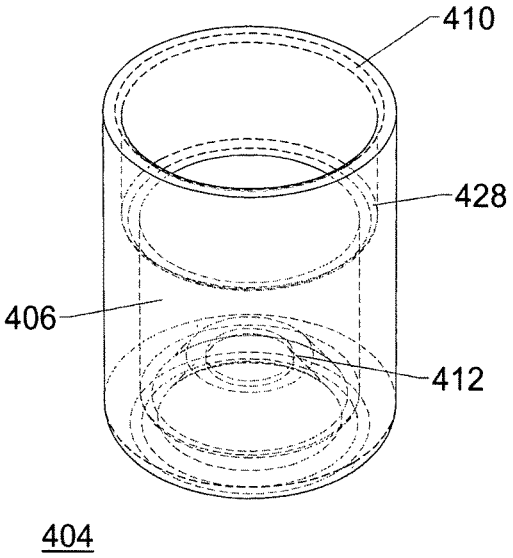
FIGS. 22A and 22B are a perspective view and a cross-sectional view, respectively, of a chamber which functions as both a receiving chamber and a storage compartment.
Figure 23A:
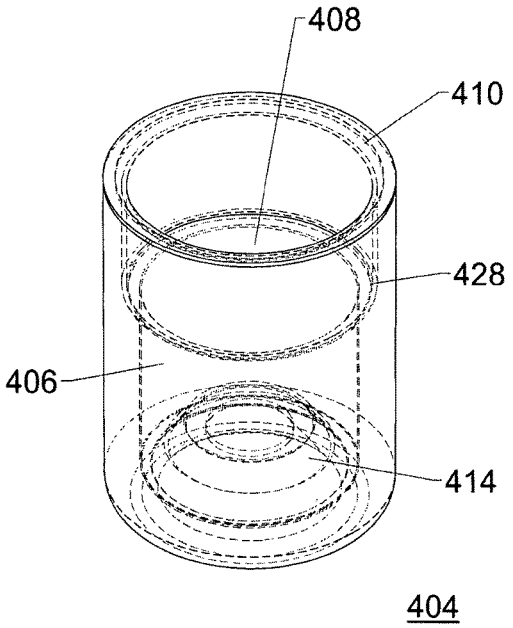
FIGS. 23A and 23B are a perspective view and a cross-sectional view, respectively, of a chamber which functions as both a receiving chamber and a storage compartment having a breachable barrier at each end.
Figure 22B:
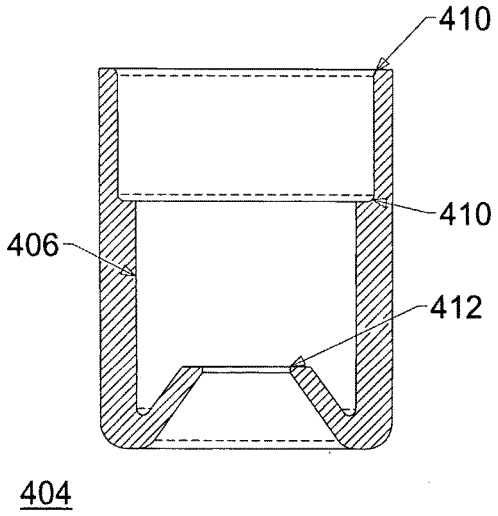
Figure 23B:
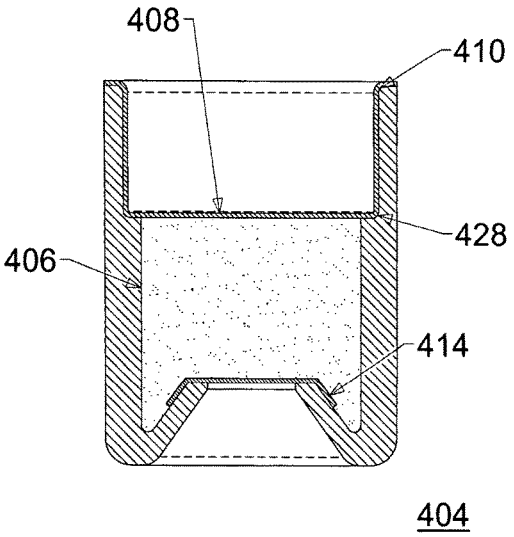
Figure 24:
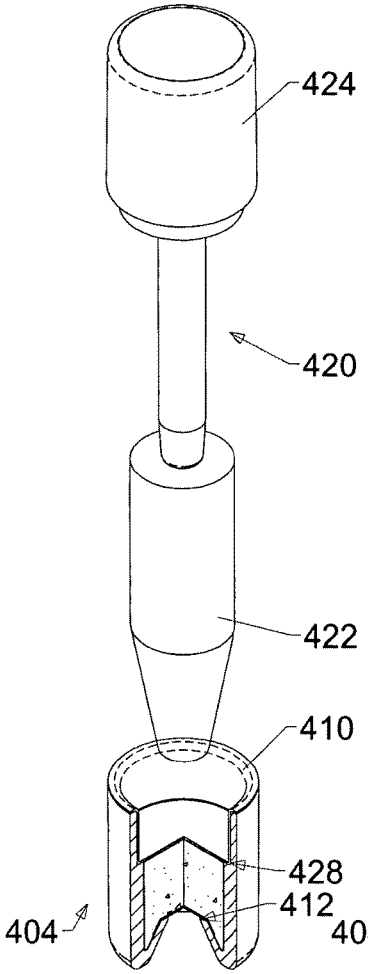
FIG. 24 is a three-quarter sectional view of the chamber of FIGS. 23A and 23B with an applicator before insertion.
Figure 25:
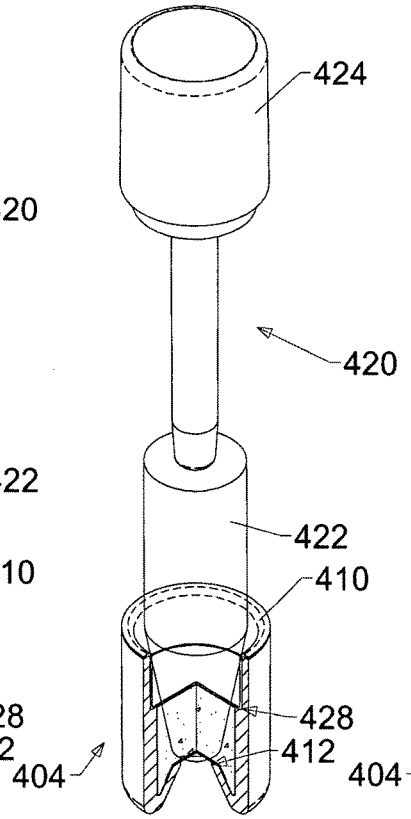
FIG. 25 is three-quarter sectional view of the chamber of FIG. 24 after the applicator has breached one of the barriers.
Figure 26:
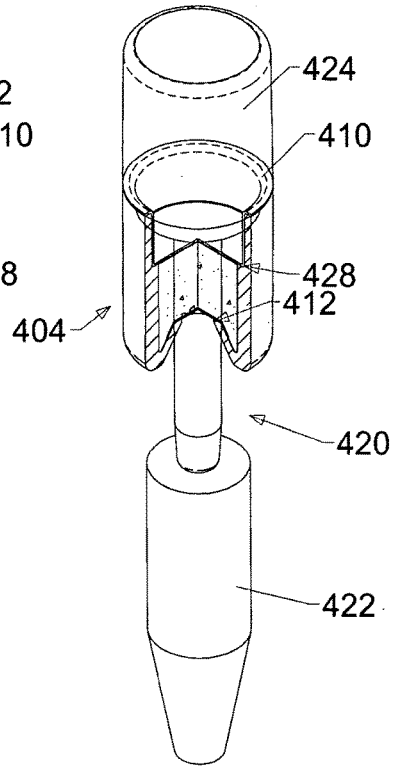
FIG. 26 is three-quarter sectional view of the chamber and applicator of FIG. 24 after the applicator has breached both barriers and the applicator head has been moved out of the chamber.

Alternatively, as shown in FIGS. 20A-20E, a transfer chamber 330 can redirect material 306 from the inner section 302 toward the edges of the fibers. In this embodiment, the material 306 from the inner section 302 flows through a central orifice 334 into a distribution chamber 332 and then to one or more longitudinal chambers 336 extending along the transfer chamber 330. Similarly, the material 304 from the outer section 308 can also be directed through separate orifices 338 into one or more separate longitudinal chambers 340. This separated, but redirected flow of materials 306, 308 results, as shown in FIG. 20E, in alternating beads of different materials on the applicator head 342.

FIG. 20B shows the longitudinal chambers or channels 336, 340 in cross-section. The material 304, 306 enters these channels 336, 340 from the distribution chamber 332 or central orifice 334 at the bottom of the transfer chamber 330 and, under pressure, the material travels up the respective channel. The channels 336, 340 are formed so that the longitudinal slots 341 which open the channels to the receiving area are narrow enough so that the viscosity of the material 304, 306 prevents the material alone from exiting the channels. However, the slots 341 are also wide enough to permit entry of the fibers of the applicator head 342 into the channels. Accordingly, when the fibers of the applicator head 342 are inserted into the channels 336, 340, the material 304, 306 attaches to the fibers of the applicator head which can then be removed from the channels with the fibers. These slotted longitudinal chambers can also be employed in other embodiments of this invention, see for example, FIGS. 6, 7, 10-13, and 16A-17.

Figure 21A:
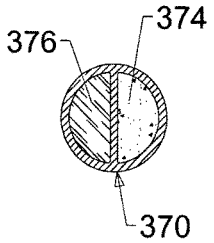
FIGS. 21A, 21B, and 21C are cross-sectional views of a cosmetic dispenser having a plunger-type storage compartment with separate sections for different materials, showing a top view, a side view, and a side view of the applicator head after the material is applied, respectively.
Figure 21B:
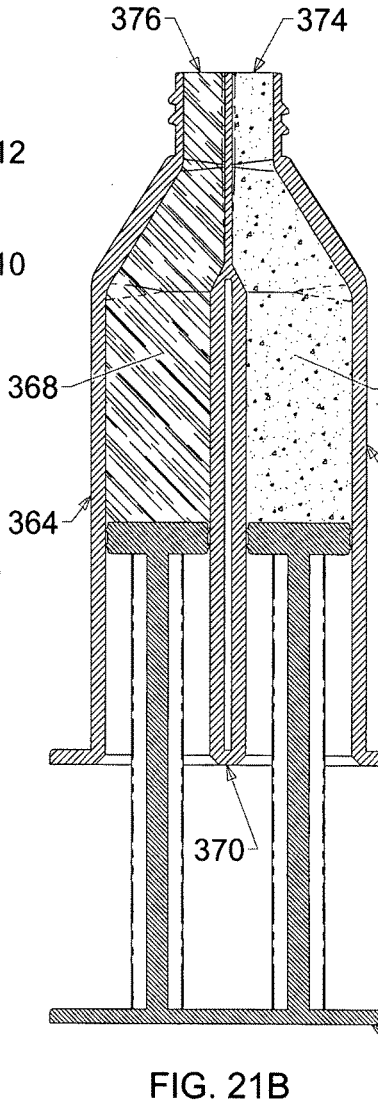
Figure 21C:
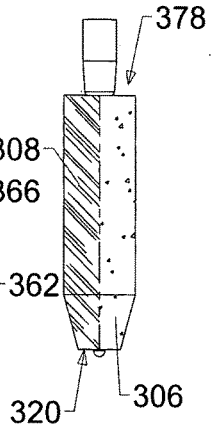

FIGS. 21A-21C illustrate one embodiment in which a plunger-type storage compartment 360 has two adjacent sections 362, 364. One material 366 is stored in one section 362 and another material 368 is stored in the other section 364. The materials 366, 368 are separated by one or more walls 370. In FIG. 21B, as the dual plunger 372 is depressed, materials 366, 368 flow through respective orifices 374, 376 into a transfer chamber. If the orifice of the transfer chamber receiving material is centered with respect to the core of the applicator head 378, the materials 366, 368 will flow longitudinally through the fibers of the applicator head 378 corresponding to the respective cross-sectional portion of the storage chamber orifices 374, 376. Thus, if the wall 370 evenly divides the output material from the storage compartment 360, the applicator head 378 will have one longitudinal half receiving one material 366 and the other longitudinal half receiving the other material 368.

In some embodiments of this invention, see for example FIGS. 22A-26, the chamber 404 provides the functionality of both the receiving chamber and the storage compartment. In one such embodiment, the material 406 initially is sealed in the chamber 404 by a removable or breachable barrier 408 which blocks access to the chamber 404 from the orifice 410 of the chamber 404 through which an applicator 420 will pass to receive the material 406. In this embodiment, the breachable barrier 408 is formed from aluminum foil which is applied across the orifice 410 by induction. However, barriers 408 made of plastics, other metals, plastic-metal laminates, paper, etcetera also can be used. To access the material 406, a user can remove the barrier 408 or, preferably, puncture, punch, poke or otherwise breach the barrier. The barrier 408 can be breached by any instrument which provides sufficient pressure to push through the barrier and allow access to the chamber 404. For example, a portion of the applicator such as the brush or head 422, the grip of the applicator 424, a user's fingernail, a punch, etcetera can be used. Use of the applicator brush 422 as the breacher, however, allows for immediate insertion of the applicator into the receiving space as the barrier 408 is breached.

Once breached, at least a portion of the applicator 420 is inserted into the chamber 404 where the material 406 transfers to at least a portion of the applicator, such as the brush or head 422 of the applicator. Thus, before the barrier 408 is breached, the chamber 404 acts as storage compartment, and after the applicator 420 is inserted through the breached barrier, the chamber 404 acts as the receiving space. Since the material 406 is already in the effective receiving space of the chamber 404, the material need not be transferred from a separate storage compartment by the user into the chamber by pressure or other means as provided by other embodiments.

In one embodiment, the portion of the applicator 420 which has received material 406 can be withdrawn from the chamber 404 through the orifice 410 so that the applicator can be used by the user to apply the material 406 to a surface. However, the chamber 404 can have an additional orifice 412 through which at least a portion of the applicator 420 can pass out from the chamber 404 after receiving the material 406 for use. As with the first orifice 410, in one embodiment, this additional orifice 412 is sealed with an additional breachable barrier 414, which is removed or breached to allow a portion of the applicator to pass from the chamber 404 for use. While any breacher can be used to breach the additional barrier 414, if the applicator head 422 used, the applicator head can breach the barrier 408 through the first orifice 410, receive the material 406 as the head passes through the chamber 404, and breach the additional barrier 414 from inside the chamber to pass out of the chamber through the additional orifice 412 with the material ready for application by the user. This embodiment allows the user to have the material 406 sealed in the chamber 404 applied to the applicator head 422 simply by pushing the applicator 420 in one direction.

To prevent the applicator 420 from being pushed completely through the chamber 404, as shown in FIGS. 22A-26, the chamber can be provided with a stop 428 which blocks the applicator grip 424 from passing though the orifice 410. In this embodiment, the applicator grip 424 is wider than the orifice 410 where the stop 428 is positioned. The applicator grip 428 can also be made longer than longitudinal length of the orifice 410 behind the stop 428 to allow the user to pull the applicator head 422 back into or through the chamber 404 to have more material 406 transferred to the applicator brush 422.

In another embodiment, the chamber 404 can be placed within a dispenser which guides the applicator 420. For example, the chamber 404 could attach to the ring 142 shown in FIG. 8. In such an embodiment, the ring 142 could provide one type of material from the tube 148 to the applicator head 422 while the chamber 404 would provides another material. Alternatively, the ring 142 need not provide an additional material, but only act as a support for the chamber. Also, the tube 148 could be replaced by a simple handle which attaches to the chamber.

While this invention has been described with various examples, combining of the these examples and inclusion of various features from one to the other are contemplated by this invention. For example, the pump of the embodiment shown in FIGS. 16A, 16B, and 17 can be replaced by the plunger of the embodiment shown in FIGS. 14A and 14B and vice versa.

It is to be understood that the invention is not limited to the features and embodiments hereinabove specifically set forth, but may be carried out in other ways without departure from its spirit.

What is claimed is:

1. A cosmetic dispenser comprising: an applicator; a storage compartment enclosing a material; and a chamber having one or more openings into a receiving area for at least a portion of the applicator and an outer orifice and one or more inner orifices, wherein the material is forced out of the storage compartment through the outer orifice into the chamber, and wherein the material flows from the chamber through the one or more inner orifices to the receiving area.

2. The cosmetic dispenser of claim 1 further comprising:

a pressurizer for causing material in the storage compartment to flow through the orifices into the chamber.

3. The cosmetic dispenser of claim 1 wherein the chamber further comprises:

an outer chamber into which material from the storage compartment flows; and one or more inner orifices through which material from the outer chamber flows into the receiving area.

4. The cosmetic dispenser of claim 1 wherein the chamber is remote from the storage compartment.

5. The cosmetic dispenser of claim 4 wherein one or more of the orifices of the chamber is connected to the storage compartment.

6. The cosmetic dispenser of claim 3 wherein the outer chamber is formed in the shape of a ring.

7. The cosmetic dispenser of claim 2 wherein the pressurizer comprises at least one wall of the storage compartment.

8. The cosmetic dispenser of claim 1 wherein the chamber has a curved shape.

9. A cosmetic dispenser comprising: an applicator; a storage compartment enclosing cosmetic product; and a chamber having an inner wall at least partially surrounding a receiving area for at least a portion of the applicator and an outer orifice through which cosmetic product is forced out of the storage compartment into the chamber, said inner wall having one or more inner orifices through which cosmetic product from the chamber can flow into the receiving area and onto the applicator.

* * * * *